US005729274A

United States Patent [19]

Sato

[11] Patent Number: 5,729,274

[45] Date of Patent: Mar. 17, 1998

[54] COLOR DIRECT THERMAL PRINTING METHOD AND THERMAL HEAD OF THERMAL PRINTER

[75] Inventor: Masamichi Sato, Saitama, Japan

[73] Assignee: Fuji Photo Film Co., Ltd., Kanagawa, Japan

[21] Appl. No.: 633,557

[22] Filed: Apr. 17, 1996

Related U.S. Application Data

[63] Continuation of Ser. No. 145,187, Nov. 3, 1993, abandoned.

[30] Foreign Application Priority Data

Nov. 5, 1992 [JP] Japan ..... 4-296116
Nov. 18, 1992 [JP] Japan ..... 4-308784

[51] Int. Cl.[6] ..... B41J 2/32

[52] U.S. Cl. ..... 347/173; 347/175

[58] Field of Search ..... 347/173, 175; 400/120.02, 120.03

[56] References Cited

U.S. PATENT DOCUMENTS 4,734,704 3/1988 Mizutani et al. .
4,786,916 11/1988 Kato ..... 347/200
4,795,887 1/1989 Myokan ..... 347/200
4,806,950 2/1989 Sekine et al. ..... 347/183
4,833,488 5/1989 Mizutani et al. .
4,857,941 8/1989 Kaida ..... 347/212
5,019,836 5/1991 Iwata et al. ..... 347/182
5,376,952 12/1994 Kokubo et al. ..... 347/172
5,398,050 3/1995 Sato ..... 347/172

FOREIGN PATENT DOCUMENTS 61-227067 10/1986 Japan .
3-288688 12/1991 Japan .

*Primary Examiner*—Huan H. Tran

[57] ABSTRACT

A color thermal recording medium has three thermosensitive coloring layers for cyan, magenta and yellow formed in this order from the base material side. The upper layer has a higher thermal recording sensitivity. The color thermal recording medium is thermally recorded by three thermal heads by a one-pass method. At least two of the three thermal heads are driven in time-sharing fashion. Besides, drive voltage for the thermal heads for recording uppermost and next uppermost thermosensitive coloring layers are set lower than that applied for the thermal head for the innermost thermosensitive coloring layer. Instead of or in addition to adjusting the drive voltages, the maximum duration of drive times may be changed for each color.

23 Claims, 8 Drawing Sheets

To1

Ty1
HEAD(16)
Ey1

Tm1
HEAD(17)
Em1

Tc1
HEAD(18)
Ec1

MOTOR(9)

FIG. 8
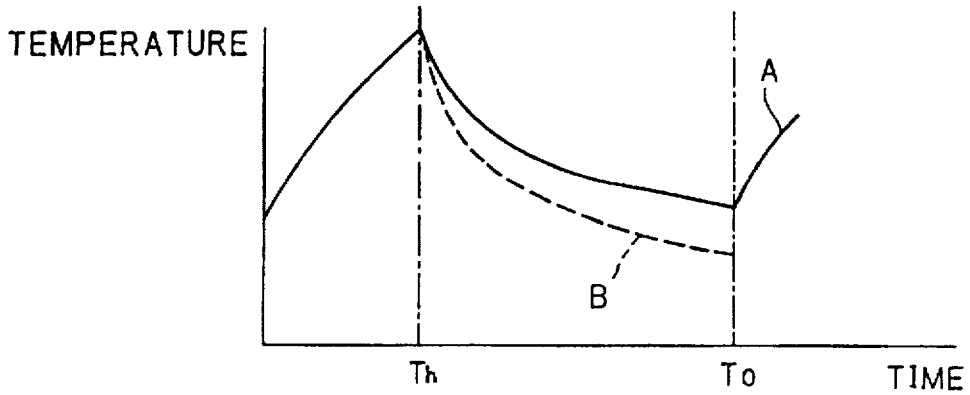
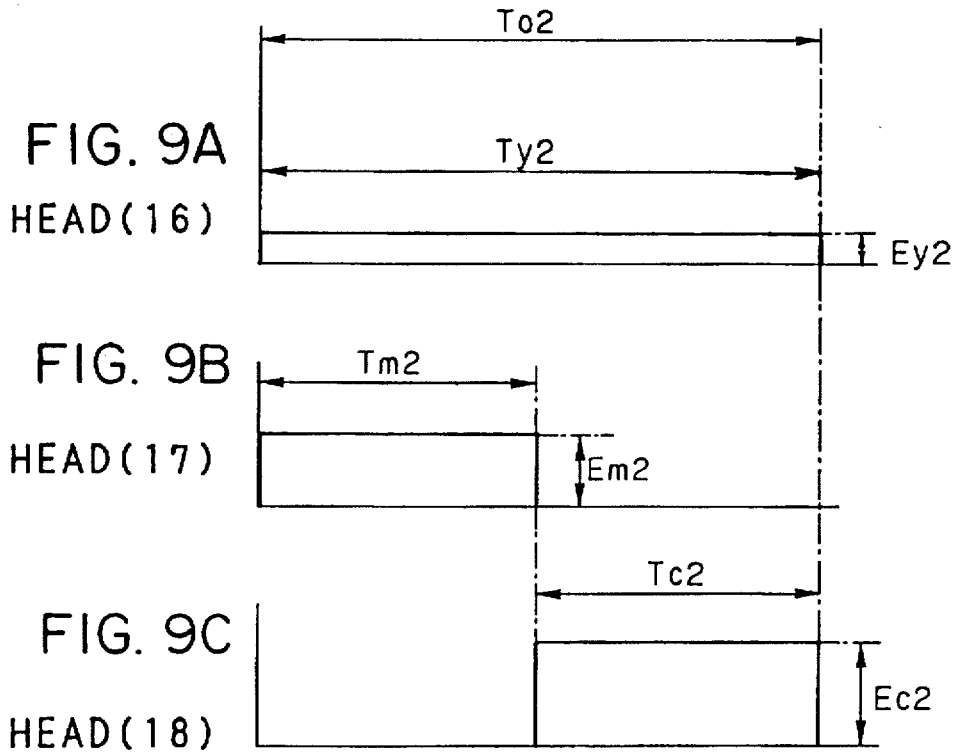

To3
Ty3

HEAD(16)
Ey3
Tm3

HEAD(17)
Em3
Tc3

HEAD(18)
Ec3

HEAD(16)

HEAD(17)

HEAD(18)

COLOR DIRECT THERMAL PRINTING METHOD AND THERMAL HEAD OF THERMAL PRINTER

This application is a continuation of application Ser. No. 08/145,187 filed on Nov. 3, 1993, now abandoned.

BACKGROUND OF THE INVENTION

1. Field of the Invention

The present invention relates to a direct color thermal printing method using a thermal color recording medium which is colored when heated. The present invention also relates to a direct color thermal printer.

2. Description of the Related Art

As a thermal color recording medium, there is known a direct color thermal recording medium (hereinafter simply called a thermal recording medium) disclosed, for example, in U.S. Pat. No. 4,734,704 and U.S. Pat. No. 4,833,488 (both corresponding to JPA 61-213169 and JPA 3-288688), having thermosensitive coloring layers for yellow, magenta and cyan which are laminated or formed on a supporting material in this order from the upside. In this type of thermal recording medium, the heat sensitivities of the thermosensitive coloring layers become lower with the distance from the upper surface. Furthermore, the coloring layers have properties that each coloring layer is optically fixed by electromagnetic rays of a respective specific wave length range.

When recording a multi-color image on the above-described thermal color recording medium, at least a thermal head having a plurality of heating elements arranged in a line is used. The thermal head is moved relative to the thermal color recording medium. First, yellow pixels of a multi-color image is thermally recorded in the coloring layer for yellow, or the uppermost coloring layer. Thereafter, the thermal color recording medium is exposed to light having a wave length range by which a diazonium salt compound still contained in this uppermost layer is decomposed. By decomposing the diazonium salt compound that have capacity for coupling, the uppermost layer is optically fixed.

Next, magenta pixels of the multi-color image is recorded in the coloring layer for magenta, or the second layer that is disposed in the second place from the upside, by using a higher heat energy than that applied for the yellow pixel recording. Thereafter, the second layer is optically fixed by being exposed to light having a wave length range that decomposes a diazonium salt compound still contained in the second layer and having capacity for coupling. Then, the highest heat energy is applied to the thermal color recording medium, so as to record a cyan frame of the multi-color image in the coloring layer for cyan, that is, the undermost coloring layer.

In one type of the above-described direct color thermal recording method, a single thermal head is used, and the thermal color recording medium is three times passed by the thermal head so as to record one color frame after another of a multi-color image. This type may be called as a three-pass method. In another type of the direct color thermal recording method, that may be called as one-pass method, a multi-color image is thermally recorded by passing the thermal color recording medium once through a path along which three thermal heads are mounted at a predetermined interval. In the one-pass type direct color thermal printing method, the recording speed for each thermosensitive coloring layer is constant.

Because of the single thermal head, the three-pass method can be simple in construction. But, a relatively long time is necessary for recording a multi-color image, because the recording medium must be three times passed by the thermal head. With the one-pass method, although the recording time can be shortened, three thermal heads must have been driven substantially at the same timing. Therefore, maximum instantaneous power consumption has been remarkably larger than that of the three-pass method, so that it is necessary to use a power supply circuit having a large capacity enough for powering three thermal heads substantially at the same timing. This results in increasing the manufacturing cost of the printer.

SUMMARY OF THE INVENTION

It is a principal object of the present invention to provide a one-pass type direct color thermal printing method and a direct color thermal printer, capable of reducing the maximum instantaneous power consumption necessary for driving three thermal heads of the printer to the lowest possible amount like a single thermal head.

In order to achieve the above and other objects, the present invention drives at least two of the three thermal heads in time sharing fashion.

The lower the sensitivity of a thermosensitive coloring layer, the larger heat energy per unit time of a thermal head should be generated. Therefore, according to an embodiment of the present invention, a voltage applied to each thermal head or a maximum drive time of heating elements of each thermal head is changed with the sensitivity of the coloring layer in addition to the time-shared drive of the thermal heads.

A preferred embodiment provides a setting $E1<E2<E3$, wherein E1 represents a voltage applied to the first thermal head for recording the uppermost coloring layer, E2 represents a voltage applied to the second thermal head for recording the second coloring layer, and E3 represents a voltage applied to the third thermal head for recording the undermost coloring layer.

Another preferred embodiment provides a setting $T1<T2<T3$, wherein T1 represents a maximum drive time for driving the first thermal head, T2 represents a maximum drive time for driving the second thermal head, and T3 represents a maximum drive time for driving the third thermal head.

BRIEF DESCRIPTION OF THE DRAWINGS

The above and other objects and advantages of the present invention will become apparent from the detailed description of the preferred embodiments when read in conjunction with the accompanying drawings, in which:

FIG. 8 is a graph showing heat-accumulating properties of the thermal head shown in FIG. 7 and the conventional thermal head;

FIGS. 9A–9C schematically show drive timing of the three color thermal heads, according to another embodiment of the invention;

DETAILED DESCRIPTION OF THE PREFERRED EMBODIMENTS

Figure 1:
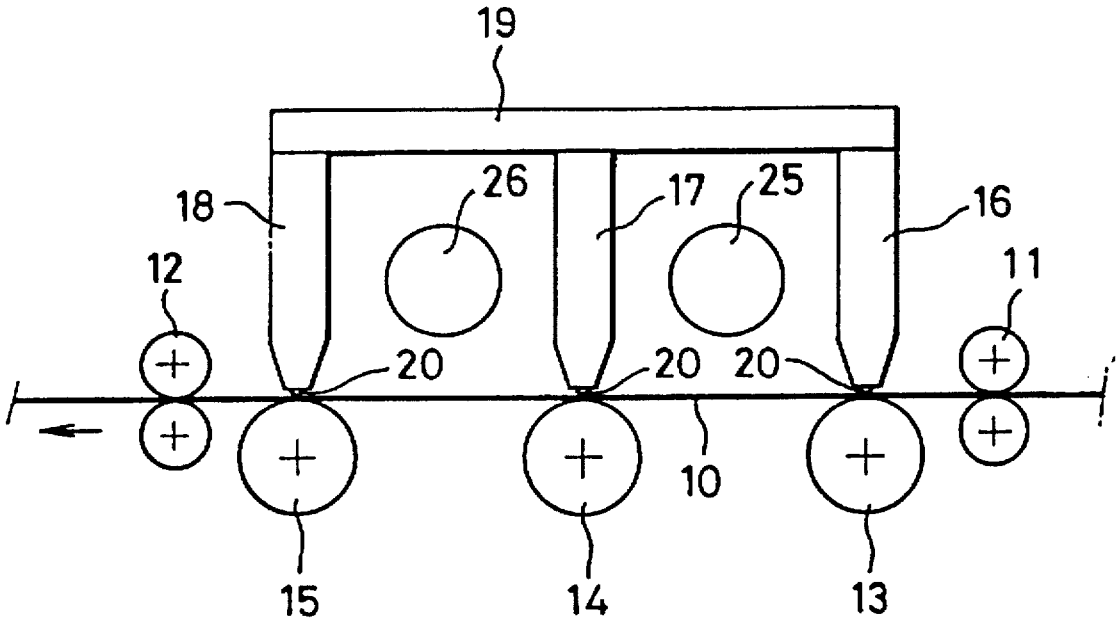
FIG. 1 is a schematic diagram of a color thermal printer embodying the present invention.
Figure 4:
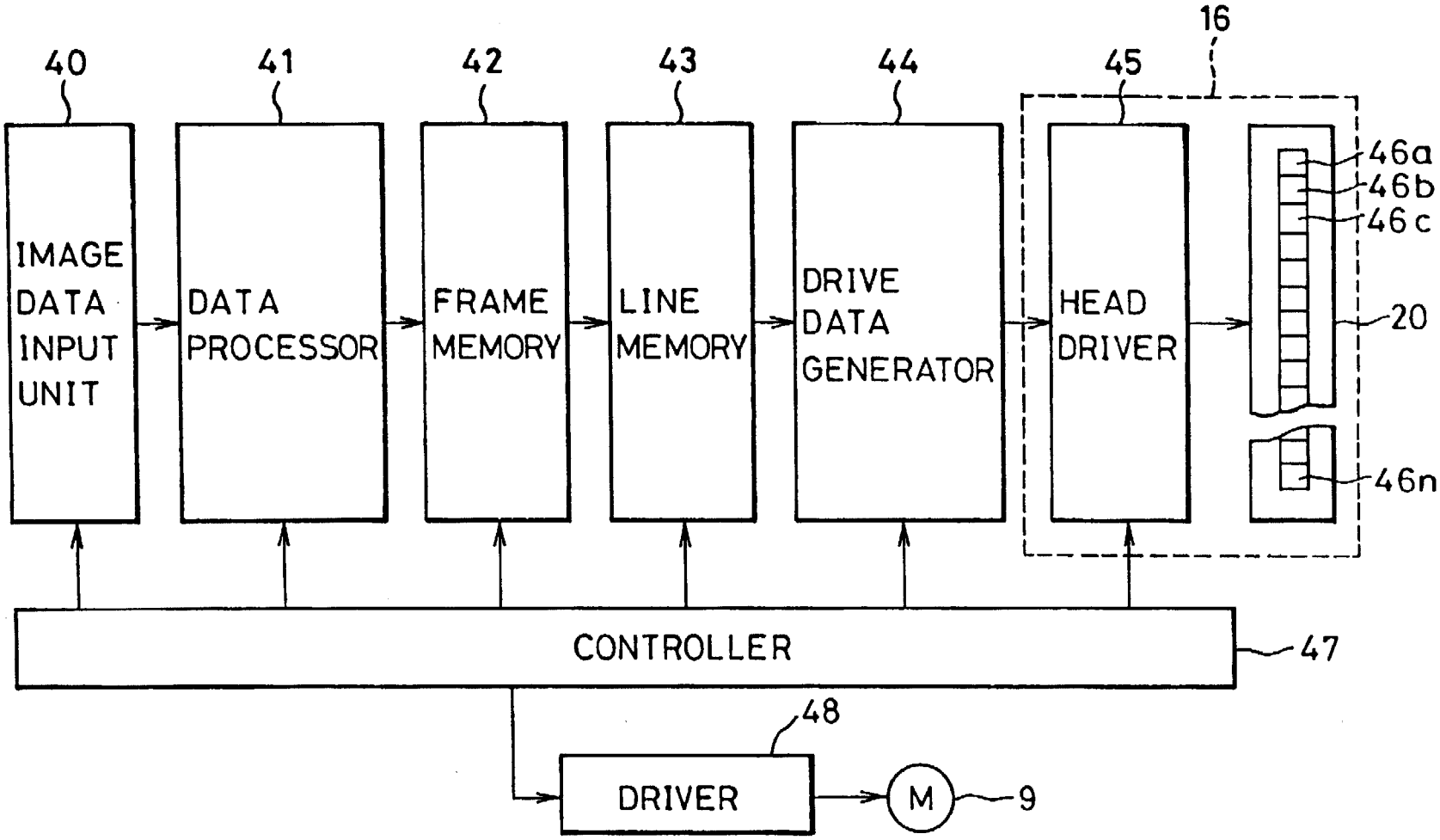
FIG. 4 is a block diagram showing the electric circuit of the color thermal printer.

FIG. 1 shows a color thermal printer for recording a multi-color image on a thermal recording medium 10 having three thermosensitive coloring layers. The thermal recording medium 10 is transported at a constant speed by transport roller pairs 11 and 12 which are rotated by a pulse motor 9 (refer to FIG. 4). Between the roller pairs 11 and 12, three platen rollers 13, 14, and 15 are provided in this order from the roller pair 11 side. Above the platen rollers 13 to 15, there are provided a thermal head for yellow layer (first thermal head) 16, thermal head for magenta layer (second thermal head) 17, and thermal head for cyan layer (third thermal head) 18 in this order from the upstream of the transport path along which the thermal recording medium 10 is advanced. Each thermal head 16, 17, 18 is of an elevation type and is mounted on a frame 19. A heating element array 20 is mounted on the bottom of each thermal head 16 to 18 as shown in FIG. 4. As well known in the art and shown in FIG. 4, the heating element array 20 has a plurality of heating elements 46*a*, 46*b*, . . . arranged in a line in the direction perpendicular to the transport direction of the thermal recording medium 10.

A fixing lamp 25 for yellow layer is mounted between the first and second thermal heads 16 and 17, and a fixing lamp 26 for magenta layer is mounted between the second and third thermal heads 17 and 18. The fixing lamp 25 for yellow layer is an ultraviolet lamp in a long shape and having a light emission peak at 420 nm, and the fixing lamp 26 for magenta layer is an ultraviolet lamp having a light emission peak at 365 nm. These lamps 25 and 26 are set within lamp houses defined by the thermal heads 16 to 18 and frame 19, so that light is shielded from the outside of the lamp houses.

Figure 2:
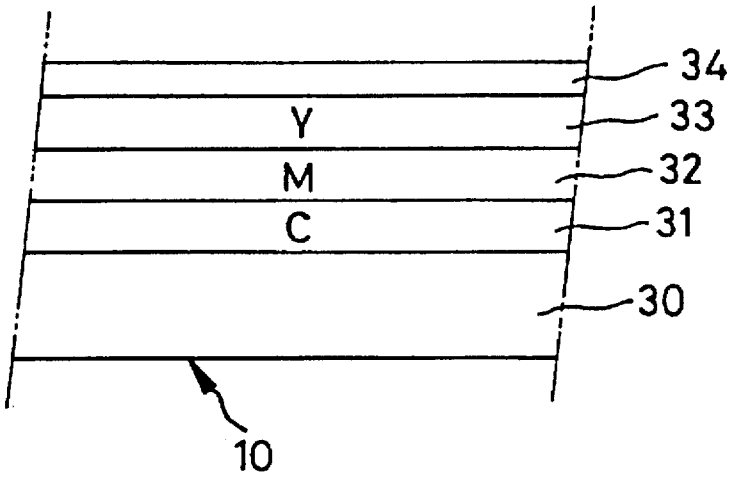
FIG. 2 illustrates an example of the layered structure of thermal recording medium.
Figures 3A, 3B, 3C, 3D:
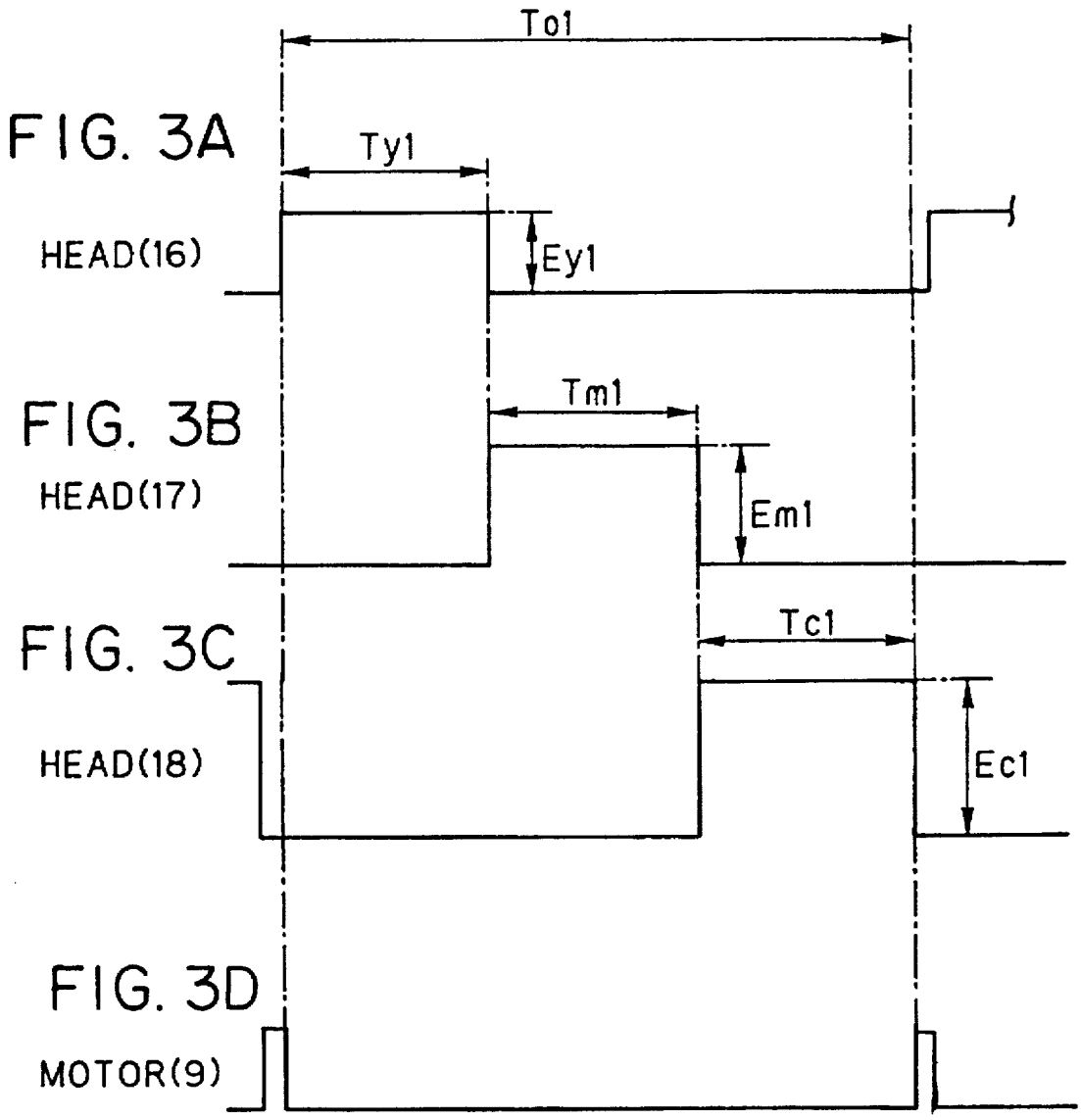
FIGS. 3A–3D schematically show timing charts of drive signals applied to three color thermal heads in relation to drive pulses applied to a pulse motor for transporting the recording medium, according to an embodiment of the invention.

FIG. 2 illustrates an example of the thermal recording medium 10. A cyan thermosensitive coloring layer 31, magenta thermosensitive coloring layer 32, yellow thermosensitive coloring layer 33, and protection layer 34 are made on a supporting material 30 in this order from the supporting material side. Since the thermosensitivity is lower at the lower layer, it is possible to selectively color the three thermosensitive coloring layers 31 to 33 by changing the coloring heat energy per unit area applied to the thermal recording medium 10. Specifically, the cyan thermosensitive coloring layer 31 is the undermost layer with the lowest thermosensitivity, so that it is necessary to supply large bias heat energy for developing cyan color therein. On the other hand, a lower bias heat energy is required for developing color in the magenta and yellow thermosensitive coloring layers 32 and 33 which are nearer to the upper surface. Intermediate layers may be provided between respective coloring layers.

According to an embodiment of the present invention, voltages Ey1 and Em1, which are applied to the first and second thermal heads 16 and 17 for the yellow and magenta coloring layers 33 and 32 having the highest and next highest heat Sensitivities, are set lower than a voltage Ec1 to be applied to the third thermal head 18 for the cyan thermosensitive coloring layer 31 having the lowest heat sensitivity.

Besides the above variation of the voltage values, drive times Ty1, Tm1 and Tc1 of the first to third thermal heads 16, 17 and 18 are shifted from each other so as not to be overlap each other. That is, the three thermal heads 16, 17 and 18 are driven in time-sharing fashion. In FIGS. 3A–3D To1 represent a line recording period necessary for all the three heads 16 to 18 to complete recording respective pixels in each allocated line. To1 does not include time for transporting the recording medium 10 stepwise by a pixel amount in the sub-scan direction. In this way, the instantaneous maximum power consumption during the thermal recording can be lowered comparably to the above-described three-pass method using a single thermal head.

It is to be noted that the affix "y" added to each pulse indicates the pulse is associated with yellow image recording, the affix "m" indicates the pulse is associated with magenta image recording, and the affix "c" indicates the pulse is associated with cyan image recording. And that, FIGS. 3A–3D show a case where the heating times Ty1, Tm1 and Tc1 have the maximum values so as to record the three color dots at highest densities.

FIG. 4 is an electric circuit diagram of the color thermal printer. An image data input unit 40 is constructed of a color scanner, electronic color still camera, or the like, and sends image data of three colors, red, green, and blue, to a data processor 41. This data processor 41 performs color correction, gradation correction, and the like for each color data. Each processed color image data is sent to a frame memory 42 and stored therein separately for each color. For the thermal recording, three color image data are read from the frame memory 42 one line after another, and written in a line memory 43. Each color image data of one line read from the line memory 43 is sent to a drive data generator unit 44 to convert each color data into drive data of complementary color.

Figure 6:
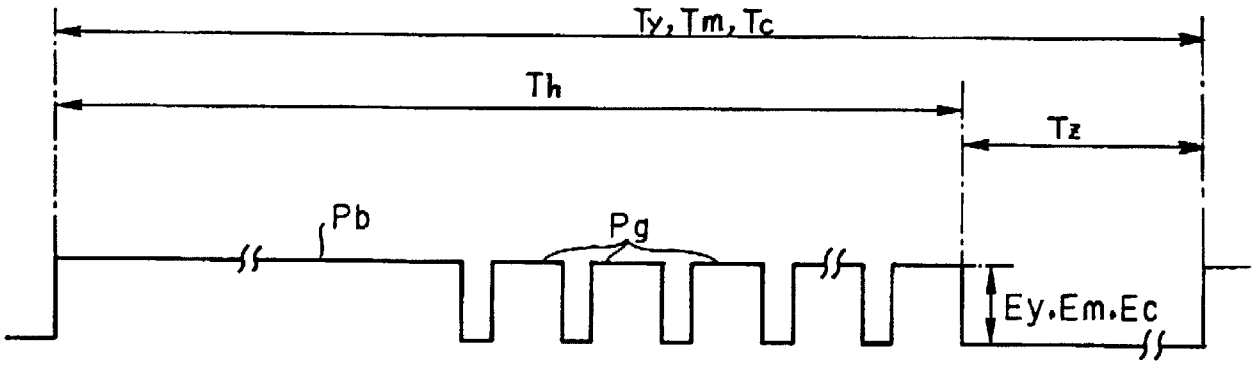
FIG. 6 shows a detailed waveform of each head drive signal supplied to each heating elements of each thermal head.

Drive data for one pixel includes a bias drive data for generating bias heat energy and an image drive data for generating heat energy for reproducing gradation. In detail, each head drive signal to be applied to each heating element has a waveform as shown in FIG. 6. The drive time Ty, Tm or Tc is defined by a bias pulse having a relatively large pulse width for heating the thermal head up to a critical temperature above which coloring is effected, a number of image pulses Pg, and a cooling time Tz. The number of image pulses Pg corresponds to recording density of the pixel. The peak voltage of these pulses correspond to voltage Ey, Em or Ec applied to the thermal head 16, 17 or 18, respectively. The pulse width of the bias pulse Pb and that of the image pulse Pg are determined for each color. In the embodiment of FIG. 3, as the application voltages Ey1, Em1 and Ec1 are changed for each color, the pulse width of the bias pulse Pb or that of the image pulse Pg may be equal for all color. The cooling time Tz is necessary for cooling the heating element so as to prevent undesirable coloring of the pixel subsequent to the just colored pixel. Such a trouble may otherwise be caused by heat energy accumulated in the heating element during each heating time Th. Besides, a short cooling time is provided between the image pulses Pg because the life time of the thermal head is shortened if each heating element is continuously driven.

Drive data of one line is supplied to a head driver 45 to control power to be supplied to heating elements 46*a* to 46*n* of the heating element array 20. In FIG. 4, merely the head driver 45 of the first thermal head 16 is shown because the second and third thermal heads 17 and 18 have the same construction as the first thermal head 16. These heating elements 46*a* to 46*n* are arranged in a line in the main scan direction, and are given a relative motion to the thermal recording medium 10 in the sub-scan direction. A controller 47 performs a sequential control of each circuit component, and controls the pulse motor 9 via a driver 48 to rotate the transport roller pairs 11 and 12 and transport the thermal recording medium 10 at a constant speed.

Figure 5:
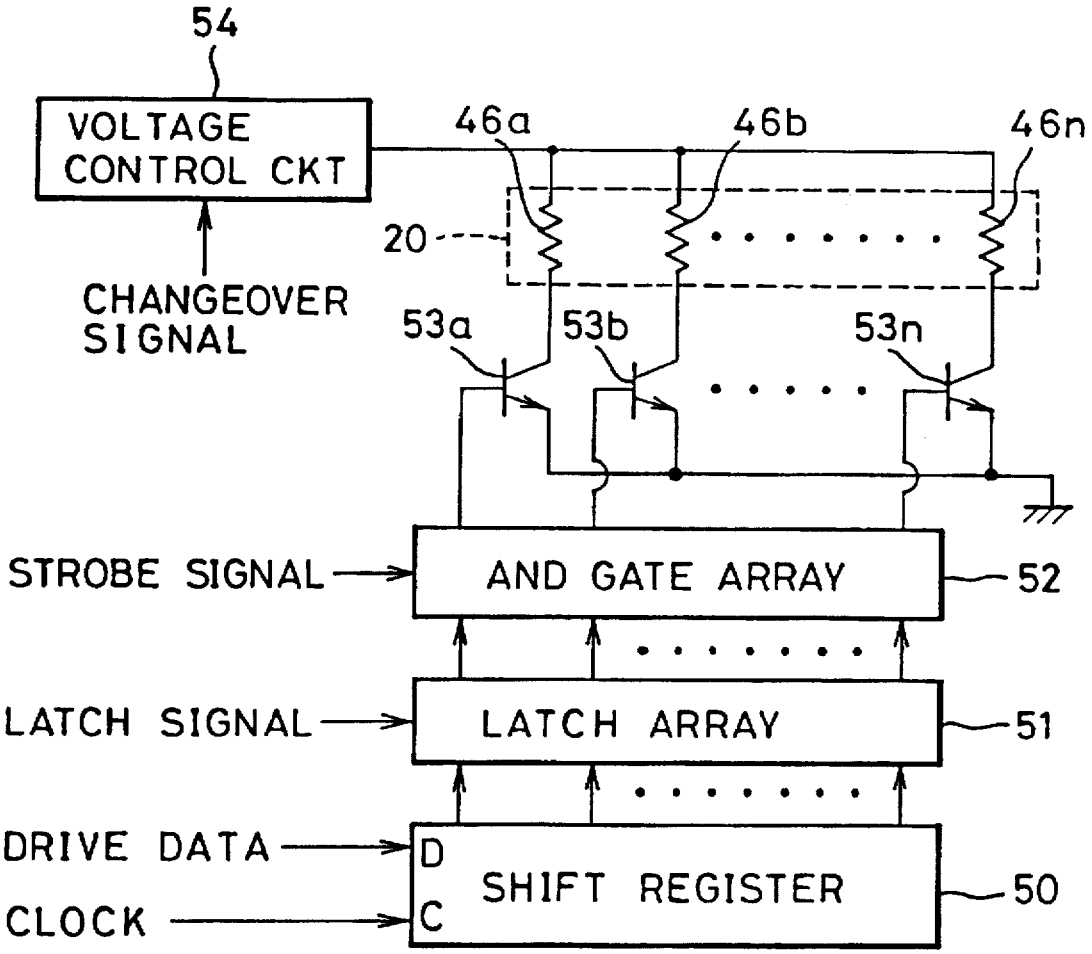
FIG. 5 is a circuit diagram of a head driver and a heating element array.

FIG. 5 shows an example of the head driver 45. Serial drive data of one line is sent to a shift register 50 synchronously with a clock signal, and converted into parallel signals. Parallel drive data converted by the shift register 50 is latched by a latch array 51 in response to a latch signal. An AND gate array 52 outputs an "H" signal in response to an input strobe signal, when the latched signal is "H". Transistors 53*a* to 53*n* are connected to output terminals of the AND gate array 52. When an "H" level signal is supplied from the output terminal of the AND gate array 52, the corresponding one of the transistors 53*a* to 53*n* is turned ON. These transistors 53*a* to 53*n* are connected via the heating elements 46*a* to 46*n* to a voltage control circuit 54 which outputs a drive voltage variable in accordance with color to be recorded, in response to a switching signal from the controller 47. Namely, for the thermal recording of the yellow thermosensitive coloring layer 33, the voltage control circuit 54 controls to apply the voltage Ey1 to the first thermal head 16, as shown in FIG. 3. For the thermal recording of the magenta and cyan thermosensitive coloring layers 32 and 31, the voltages Em1 and Ec1, which are larger than the voltage Ey1, are used to drive the second and third thermal heads 17 and 18, respectively.

Drive data of one line is obtained in the drive data generator 44, in the following manner. First, for the bias heating, drive data of "H" is assigned to all pixels of one line, and then serial drive data is obtained. With drive data of "H", each heating element is heated. Next, the image data for each pixel is compared with a comparable data representing the first step of gradation, to determine if the pixel is to be driven. If it is to be driven, "H" is assigned, and if not, "L" is assigned. Such comparison is performed for all pixels of one line to convert the image data into serial drive data. Using this serial drive data, the heating elements 46*a* to 46*n* are selectively driven. Similarly, the image data for each pixel is compared with comparable data representing the second step of gradation, to convert the image data into serial drive data. For example, in the case of 64 steps of gradation, drive data of one line including bias heating drive data is read stepwise at 65 times, and the heating elements 46*a* to 46*n* are selectively driven in response to the 65th strobe signal to reproduce an image of 64-step gradation.

As set forth above, the thermal heads 16, 17 and 18 are cooled after each heating. If cooling time is too long, there occurs a problem that the thermal heads are cooled to an unnecessarily lower temperature at the start of the next thermal recording. Therefore, cooling time should be properly controlled. However, since the drive times Ty1, Tm1 and Tc1 of the three thermal heads 16, 17 and 18 are completely shifted from one another, each thermal head is also cooled during the drive times of the other two thermal heads. Therefore, there might be a case where the thermal heads are too cooled.

Figure 7:
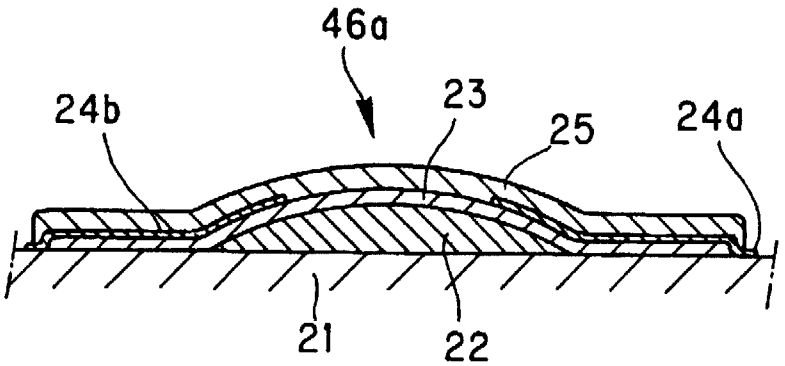
FIG. 7 is a sectional view of an embodiment of the thermal head.

To solve this problem, an embodiment of the present invention uses a thermal head having high heat-restraining properties, wherein a partial grazed glass layer 22 and a heating element 46*a* are laminated on an isolating base plate 21 made of a heat-resistant material such as alumina, as shown in FIG. 7. The heating element 46*a* is one of an array of heating elements 46*a* to 46*n*, and is constituted of a resistance layer 23, a pair of electrodes 24*a* and 24*b* connected to the resistance layer 23, and a protection layer 25 covering and protecting the elements 23, 24*a* and 24*b* from ambience. The resistance layer 23 is formed on the partial grazed glass layer 22 by vacuum deposition, sputtering, CVD, sintering or other method.

The partial grazed glass layer 22 is formed to have a semi-cylindrical shape so that the heating element 46*a* may accurately contact a sheet material to be heated. According to the present embodiment, the partial grazed glass layer 22 is made thicker than conventional. Because the partial grazed glass layer 22 has a low heat transfer coefficient and thus high heat-restraining properties, the heat-restraining efficiency of the heating element 46*a* is improved by virtue of the thick layer 22, as is shown in FIG. 8, wherein a curve A indicates the heat-restraining properties of the heating element 46*a*, while another curve B indicates those of a conventional heating element. As shown, the temperature of the heating element 46*a* goes down slower after the stop of heating, compared with the conventional heating element. FIG. 8 shows an example where the heating element 46*a* is heated for a heating time Th.

The operation of the color thermal printer will be briefly described for the case where drive voltages are varied between three colors. For the thermal recording, each image data supplied from the image data input unit 40 is processed by the image processor 41, and written in the frame memory 42 separately for each color. The thermal recording medium 10 is sent to the thermal heads 16, 17, and 18.

While the transport roller pairs 11 and 12 intermittently rotate by a predetermined step at a time, the top of the recording area of the thermal recording medium 10 reaches the first thermal head 16. At this time, the thermal recording of a yellow image starts. Yellow image data of one line is read from the frame memory 42 and temporarily stored in the line memory 43. Next, the yellow image data is read from the line memory 43, and sent to the drive data generator unit 44 which outputs drive data to the head driver 45.

The head driver 45 drives the heating elements 46*a* to 46*n* to supply the bias heat energy and gradation heat energy to the recording medium 10, thereby to develop color at a desired density. After the first line of the yellow image is recorded, the transport roller pairs 11 and 12 are stepwise rotated by one pixel amount by the pulse motor 9 so as to transport the recording medium by one pixel amount in the sub-scan direction. Then, the second line image data of the yellow image is read from the frame memory 42. In the similar manner, the yellow image of third and following lines is thermally recorded by the first thermal head 16 on the thermal recording medium 10. When the portion of the recording medium 10 having yellow pixels recorded thereon reaches the fixing lamp 25, the yellow coloring layer 33 of that portion is optically fixed.

When the portion having passed the fixing lamp 25 reaches the second thermal head 17 which is disposed next to the fixing lamp 25 in the sub-scan direction, the second thermal head 17 records the magenta image one line after another in the same manner as above, at the timing as shown in FIG. 3. The magenta image is optically fixed by the fixing lamp 26 in the same manner described above. During recording the magenta image, although the yellow coloring layer is also heated by the second thermal head 17, the layer 33 has already lost the capacity for coupling, so that no additional color will be developed in the yellow coloring layer.

When the portion having been fixed by the fixing lamps 25 and 26 reaches the third head 18, the cyan image is thermally recorded one line after another by the third thermal head 18 at the timing as shown in FIGS. 3A–3D. Since the cyan coloring layer requires high heat energy to be colored, no color will be developed under the normal storing conditions. Therefore, optical fixation for the cyan thermosensitive coloring layer is omitted. In the above manner, the thermosensitive coloring layers are thermally recorded by the thermal heads 16 to 18 by passing the thermal recording medium 10 once through the transport path, and thereafter the thermal recording medium 10 is exited onto a tray.

While the three thermal heads 16, 17 and 18 are driven in time-sharing fashion in the above embodiment, it is alternatively possible to drive two of the three thermal heads in time-sharing fashion. According to a preferred embodiment shown in FIGS. 9A–9C, the drive times Tm2 and Tc2 of the second and third thermal heads 17 and 18 are shifted from each other, while the drive time Ty2 of the first thermal head 16 overlaps with the drive times Tm2 and Tc2. It is to be noted that each drive time Ty2, Tm2 or Tc2 is constituted of a heating time Th and a cooling time Tz in the same way as shown in FIG. 6.

Because the heat energy necessary for coloring the yellow coloring layer 33 is the lowest, it is possible to set the drive voltage to be applied to the first thermal head 16 at a low level Ey2. Therefore, the overlapping of the drive time Ty2 of the first thermal head 16 with the drive times Tm2 and Tc2 of the other thermal heads 17 and 18 has no remarkable influence on the instantaneous power consumption. On the contrary, because the second and third thermal heads which consume relatively large power are not simultaneously driven, the instantaneous power consumption of this embodiment is also restrained to a low level. Therefore, the capacity of the power supply can be made small.

If the maximum drive time Ty2 of the first thermal head is set the longer, it is possible to set the drive voltage Ey2 the lower. Besides, the maximum drive times Tm2 and Tc2 of the second and third thermal heads 17 and 18 can be set longer than the values Tm1 and Tc1 selectable for the first embodiment where the drive times of all the three thermal heads does not overlap one another. Therefore, also the drive voltages Em2 and Ec2 applied to the second and third thermal heads 17 and 18 can be set lower than the values Em1 and Ec1. In alternative, it is possible to shorten a line recording time period To2 because the time period To2 can be the sum of the maximum drive times of the second and third thermal heads 17 and 18. Thereby, high recording speed is achieved.

In the foregoing embodiments, drive voltage to each thermal head is changed in accordance with the thermosensitivity of the assigned coloring layer. Instead, it is possible to change the maximum drive times of the three thermal heads in accordance with the sensitivities of the respective coloring layers.

Figures 10A, 10B, 10C:
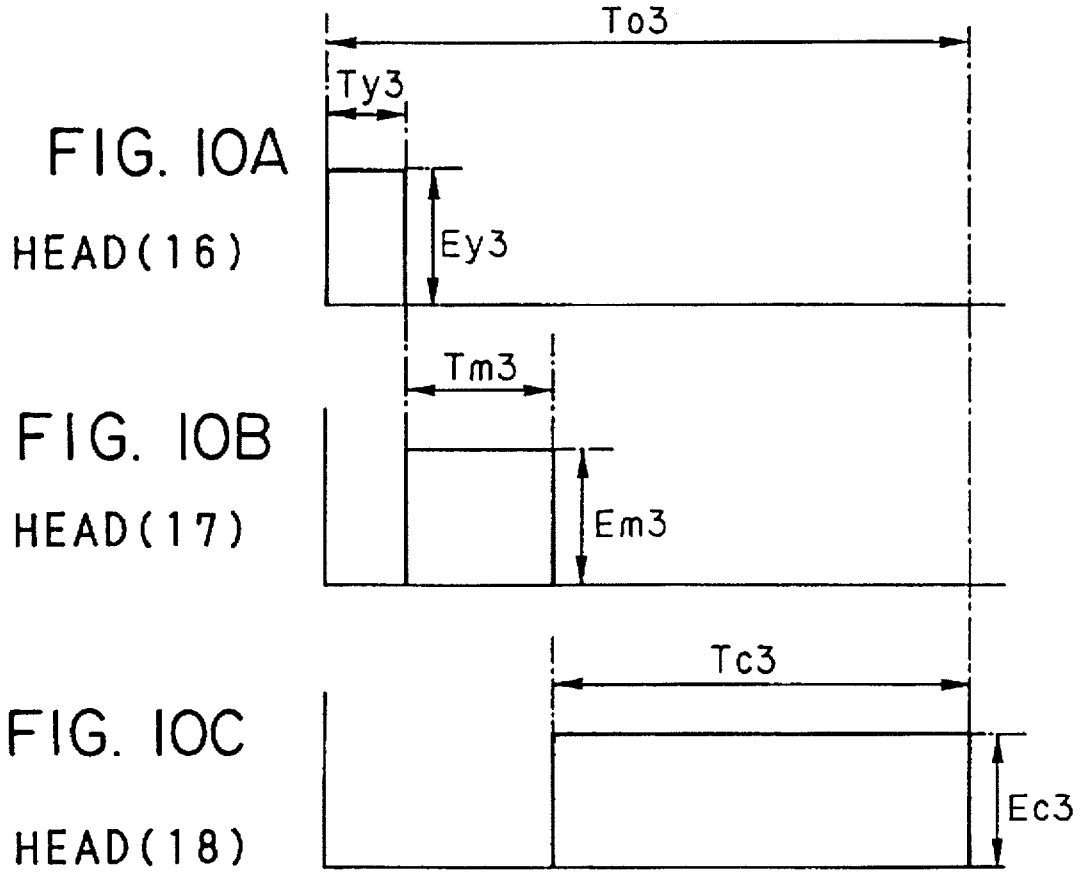
FIGS. 10A–10C schematically show drive timing of the three color thermal heads, according to a third embodiment of the invention.

FIGS. 10A–10C show such an embodiment wherein applied voltages Ey3, Em3 and Ec3 are the same value for all three colors, and the maximum drive times Ty3, Tm3 and Tc3 for the first to third thermal heads 16 to 18 are set Ty3<Tm3<Tc3, and shifted from one another so as not to overlap with one another. Also this embodiment contributes to reducing the instantaneous maximum power consumption during the thermal recording. It is to be noted that the width of bias heating pulse and that of image pulse are changed for each color in correspondence with the maximum drive time Ty3, Tm3 or Tc3.

Figures 11A, 11B, 11C:
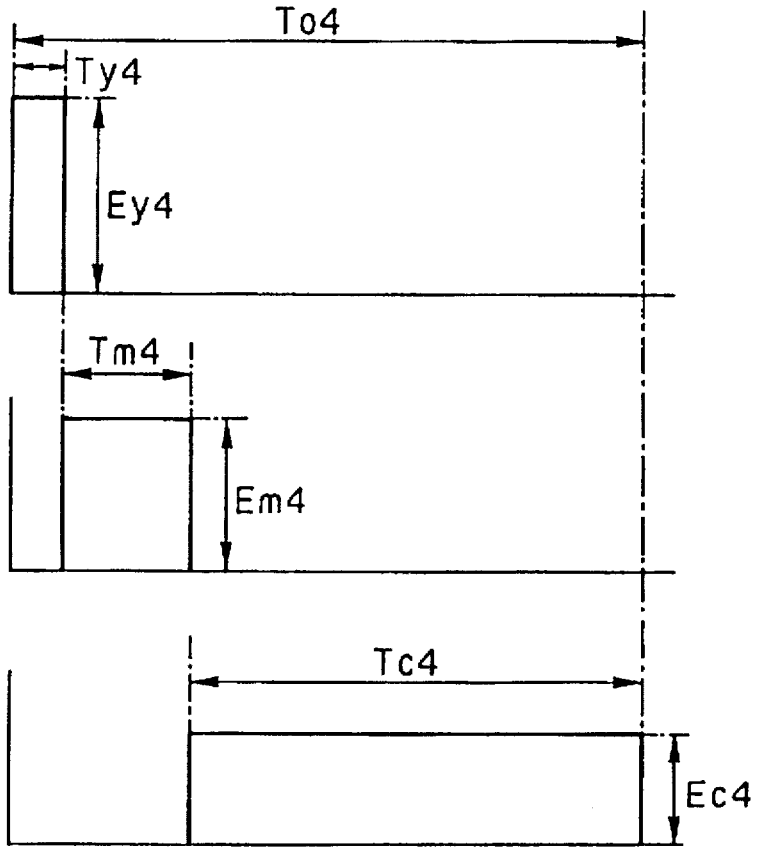
FIGS. 11A–11C schematically show drive timing of the three color thermal heads, according to a fourth embodiment of the invention.

It is also possible to change drive voltage as well as maximum drive time for each color. For example, as shown in FIGS. 11A–11C, the drive voltages Ey4, Em4 and Ec4 for the first to third thermal heads 16 to 18 are set Ey4>Em4>Ec4. Thereby, it is possible to set the maximum drive time Ty4 for the first thermal head 16 shorter than the case where the drive voltage is the same for all thermal heads. It is also possible to set the maximum drive time Tc4 for the third thermal head 18 longer than the case where the drive voltage is the same for all thermal heads. Thereby, a sufficient cooling time for the first and second thermal heads 16 and 17 is provided. Alternative, by using higher application voltages for the first and second thermal heads 16 and 17, the maximum drive times Ty4 and Tm4 becomes shorter. As a result, the line recording time period To4 is shortened, thereby to achieve a high speed recording.

Although the present invention has been described with respect to a line printer in which a number of heating elements are arranged in the main scan direction and the thermal recording medium is moved in the sub-scan direction for the thermal recording, has been described, the present invention is also applicable to a serial printer in which three thermal heads are moved in unison in the transversal direction of a thermal recording medium. Still further, the cyan, magenta, and yellow thermosensitive coloring layers are laminated on a supporting material in this order from the supporting material side. The order of layer lamination may be changed optionally. In this case, the characteristic of being optically fixable in the undermost thermosensitive coloring layer can be omitted. Obviously, optical fixability may be provided for the undermost layer.

In the foregoing description, a separate thermal head has been used for each color. An integrated thermal head assembly having three arrays of heating elements may be used as disclosed in JPA 61-227067. In this case, ultraviolet rays are emitted through slits formed between thermal heads.

Instead of making the partial grazed glass layer thicker than conventional, it may be possible to provide a heat isolating layer between the partial grazed glass layer and the alumina base plate, so as to improve the heat-restraining efficiency of the heating elements.

Although the present invention has been described with reference to the preferred embodiments shown in the drawings, the invention should not be limited by the embodiments but, on the contrary, various modifications, changes, combinations and the like of the present invention can be effected without departing from the spirit and scope of the appended claims.

What is claimed is:

1. A color thermal printing method for printing a multicolor image comprising the steps of:

passing a color thermal recording medium once through a transport path along which first to third thermal heads and first and second light sources are arranged, the color thermal recording medium having first to third thermosensitive coloring layers each developing a different color, the first to third thermosensitive coloring layers being arranged in a predetermined order having the first thermosensitive coloring layer being an uppermost layer and the third thermosensitive coloring layer being a lowermost layer with the second thermosensitive coloring layer being disposed between the first and third thermosensitive coloring layers;

thermally recording the first thermosensitive coloring layer using the first thermal head;

optically fixing the first thermosensitive coloring layer by radiating electromagnetic rays specific to the first thermosensitive coloring layer from the first light source;

thermally recording the second thermosensitive coloring layer using the second thermal head;

optically fixing the second thermosensitive coloring layer by radiating electromagnetic rays specific to the second thermosensitive coloring layer from the second light source;

thermally recording the third thermosensitive coloring layer using the third thermal head; and driving the first to third thermal heads in time-sharing fashion such that respective driving times of the first, second and third thermal heads for thermally recording the first, second and third thermosensitive coloring layers are shifted from one another so as not to overlap with one another, thereby reducing maximum instantaneous power consumption of said driving step.

2. The color thermal printing method according to claim 1, further comprising the step of:

setting a condition of E1<E2<E3, where E1 is a voltage to be applied to the first thermal head, E2 is a voltage to be applied to the second thermal head, and E3 is a voltage to be applied to the third thermal head.

3. The color thermal printing method according to claim 1, further comprising the step of:

setting a condition of T1<T2<T3, where T1 is a maximum duration of a driving time of the first thermal head, T2 is a maximum duration of the driving time of a second thermal head, and T3 is a maximum duration of a driving time of the third thermal head.

4. The color thermal printing method according to claim 3, wherein voltages applied to the first to third thermal heads are a same value.

5. The color thermal printing method according to claim 3, wherein voltages applied to the first to third thermal heads are different in value from each other.

6. A color thermal printer for printing a multi-color image comprising:

a transport path through which a color thermal recording medium passes once;

first to third thermal heads arranged along said transport path, the color thermal recording medium having first to third thermosensitive coloring layers each developing a different color, the first to third thermosensitive coloring layers being arranged in a predetermined order having the first thermosensitive coloring layer being an uppermost layer and the third thermosensitive coloring layer being a lowermost layer with the second thermosensitive coloring layer being disposed between the first and third thermosensitive coloring layers;

a first light source arranged along said transport path, which optically fixes the first thermosensitive coloring layer after the first thermosensitive coloring layer has been thermally recorded using the first thermal head, said first light source radiating electromagnetic rays specific to the first thermosensitive coloring layer;

a second light source, arranged along said transport path, which optically fixes the second thermosensitive coloring layer after the second thermosensitive layer has been thermally recorded using the second thermal head, said second light source radiating electromagnetic rays specific to the second thermosensitive coloring layer, and wherein finally the third thermosensitive coloring layer is thermally recorded using the third thermal head; and driving means for driving the first to third thermal heads in time-sharing fashion such that driving times of the first to third thermal heads are mutually exclusive, thereby reducing maximum instantaneous power consumption of said driving means.

7. The color thermal printer according to claim 6, wherein each of the first to third thermal heads includes a number of heating elements arranged in a line in a direction perpendicular to said transport path, the color thermal printer further comprising:

moving means for moving the color thermal recording medium by one line amount each time the first to third thermal heads complete recording respective color pixels of one line allocated to each of the first to third thermal heads.

8. The color thermal printer according to claim 7, wherein one of said first and second light sources is provided between two of the first to third thermal heads.

9. The color thermal printer according to claim 8, wherein each of the first to third thermal heads extends in a direction perpendicular to a surface of the color thermal recording medium so as to shield electromagnetic rays.

10. The color thermal printer according to claim 9, wherein the first thermosensitive coloring layer is a yellow thermosensitive coloring layer, the second thermosensitive coloring layer is a magenta thermosensitive coloring layer, and the third thermosensitive coloring layer is a cyan thermosensitive coloring layer.

11. The color thermal printer according to claim 10, wherein the yellow thermosensitive coloring layer is optically fixed by ultraviolet rays of substantially 420 nm, and the magenta thermosensitive coloring layer is optically fixed by ultraviolet rays of substantially 365 nm.

12. The color thermal printer according to claim 11, wherein each of the first to third thermal heads is supplied with a bias pulse for heating a respective thermosensitive coloring layer to a temperature just near to a coloring temperature and image pulses corresponding in number to a coloring density, for thermally recording one pixel.

13. A color thermal printer according to claim 12, further comprising:

means for setting a condition of E1<E2<E3, where E1 is a voltage to be applied to the first thermal head, E2 is a voltage to be applied to the second thermal head, and E3 is a voltage to be applied to the third thermal head.

14. The color thermal printer according to claim 12, further comprising:

means for setting a condition of T1<T2<T3, where T1 is a maximum duration of the driving time of the first thermal head, T2 is a maximum duration of the driving time of the second thermal head, and T3 is a maximum duration of the driving time of the third thermal head.

15. The color thermal printer according to claim 6, wherein at least two of the first to third thermal heads have high heat-restraining properties.

16. The color thermal printer according to claim 15, wherein each of the first to third thermal heads comprises:

a base plate;

a plurality of heating elements formed on said base plate, each of said plurality of heating elements having a resistance layer and a pair of electrodes connected to said resistance layer; and a partial glazed glass layer formed between said base plate and each of said plurality of heating elements, said partial glazed glass layer having a semi-cylindrical shape, and having a thickness enough for restraining heat energy therein an appropriate time after the heat energy is radiated from said resistance layer, thereby reducing temperature decay of each of said plurality of heating elements after a driving time of the first to third thermal heads.

17. A color thermal printer for printing a multicolor image comprising:

a transport path through which a color thermal recording medium passes once;

first to third thermal heads arranged along said transport path, the color thermal recording medium having first to third thermosensitive coloring layers each developing a different color, the first to third thermosensitive coloring layers being arranged in a predetermined order having the first thermosensitive coloring layer being an uppermost layer and the third thermosensitive coloring layer being a lowermost layer with the second thermosensitive coloring layer being disposed between the first and third thermosensitive coloring layers;

a first light source arranged along said transport path, which optically fixes the first thermosensitive coloring layer after the first thermosensitive coloring layer has been thermally recorded using said first thermal head, said first light source radiating electromagnetic rays specific to the first thermosensitive coloring layer;

a second light source arranged along said transport path, which optically fixes the second thermosensitive coloring layer after the second thermosensitive coloring layer has been thermally recorded using said second thermal head, said second light source radiating electromagnetic rays specific to the second thermosensitive coloring layer, and wherein finally the third thermosensitive coloring layer is thermally recorded using said third thermal head;

driving means for driving said first to third thermal heads in time-sharing fashion such that driving times of said first to third thermal heads are mutually exclusive, thereby reducing maximum instantaneous power consumption of said driving means, one of said first and second light sources being provided between two of said first to third thermal heads, each of said first to third thermal heads having high heat restraining properties, having a number of heating elements arranged in a line in a direction perpendicular to said transport path, and extending in a direction perpendicular to a surface of the color thermal recording medium to shield the electromagnetic rays radiated by said first light source from the electromagnetic rays radiated by said second light source; and moving means for moving the color thermal recording medium by one line amount each time said first to third thermal heads complete recording respective color pixels of one line allocated to each of said first to third thermal heads.

18. The color thermal printer according to claim 17, wherein each of said first to third thermal heads comprises:

a base plate;

a plurality of heating elements formed on said base plate, each of said plurality of heating elements having a resistance layer and a pair of electrodes connected to said resistance layer; and a partial glazed glass layer formed between said base plate and each of said plurality of heating elements, said partial glazed glass layer having a semi-cylindrical shape, and having a thickness enough for restraining heat energy therein an appropriate time after the heat energy is radiated from said resistance layer, thereby reducing temperature decay of said plurality of heating elements after a driving time of said first to third thermal heads.

19. The color thermal printer according to claim 18, wherein the first thermosensitive coloring layer is a yellow thermosensitive coloring layer, the second thermosensitive coloring layer is a magenta thermosensitive coloring layer, and the third thermosensitive coloring layer is a cyan thermosensitive coloring layer.

20. The color thermal printer according to claim 19, wherein the yellow thermosensitive coloring layer is optically fixed by ultraviolet rays of substantially 420 nm, and the magenta thermosensitive coloring layer is optically fixed by ultraviolet rays of substantially 365 nm.

21. The color thermal printer according to claim 20, wherein each of said first to third thermal heads is supplied with a bias pulse for heating a respective thermosensitive coloring layer to a temperature just near to a coloring temperature and image pulses corresponding in number to a coloring density, for thermally recording one pixel.

22. A color thermal printing method for printing a multicolor image comprising the steps of:

passing a color thermal recording medium once through a transport path along which first to third thermal heads and first and second light sources are arranged, the color thermal recording medium having first to third thermosensitive coloring layers each developing a different color, the first to third thermosensitive coloring layers being arranged in a predetermined order having the first thermosensitive coloring layer being an uppermost layer and the third thermosensitive coloring layer being a lowermost layer with the second thermosensitive coloring layer being disposed between the first and third thermosensitive coloring layers;

thermally recording the first thermosensitive coloring layer using the first thermal head;

optically fixing the first thermosensitive coloring layer by radiating electromagnetic rays specific to the first thermosensitive coloring layer from the first light source;

thermally recording the second thermosensitive coloring layer using the second thermal head;

optically fixing the second thermosensitive coloring layer by radiating electromagnetic rays specific to the second thermosensitive coloring layer from the second light source;

thermally recording the third thermosensitive coloring layer using the third thermal head; and driving the first to third thermal heads in time-sharing fashion with respective first through third drive voltages such that respective driving times of the first and second thermal heads for thermally recording the first and second thermosensitive coloring layers overlap and driving times of the second and third thermal heads for thermally recording the second and third thermosensitive coloring layers are shifted from one another so as not to overlap with one another, the first drive voltage being less than the second drive voltage and the second drive voltage being less than the third drive voltage, thereby reducing maximum instantaneous power consumption of said driving step.

23. A color thermal printing method for printing a multicolor image comprising the steps of:

passing a color thermal recording medium once through a transport path along which first to third thermal heads and first and second light sources are arranged, the color thermal recording medium having first to third thermosensitive coloring layers each developing a different color, the first to third thermosensitive coloring layers being arranged in a predetermined order having the first thermosensitive coloring layer being disposed as an uppermost layer and the third thermosensitive layer being disposed as a lowermost layer with the second thermosensitive layer being disposed between the first and third thermosensitive coloring layers;

thermally recording the first thermosensitive coloring layer using the first thermal head;

optically fixing the first thermosensitive coloring layer by radiating electromagnetic rays specific to the first thermosensitive coloring layer from the first light source;

thermally recording the second thermosensitive coloring layer using the second thermal head;

optically fixing the second thermosensitive coloring layer by radiating electromagnetic rays specific to the second thermosensitive coloring layer from the second light source;

thermally recording the third thermosensitive coloring layer using the third thermal head; and driving the first to third thermal heads in time-sharing fashion with respective first through third drive voltages such that respective driving times of the first, second and third thermal heads for thermally recording the first, second and third thermosensitive coloring layers are shifted from one another so as not to overlap with one another, the first through third drive voltages being equal, thereby reducing maximum instantaneous power consumption of said driving step.

* * * * *